US007350360B2

(12) United States Patent
Graf et al.

(10) Patent No.: US 7,350,360 B2
(45) Date of Patent: Apr. 1, 2008

(54) ANNULAR COMBUSTOR FOR A GAS TURBINE

(75) Inventors: Peter Graf, Küssaberg (DE); Stefan Tschirren, Nunnigen (CH); Helmar Wunderle, Waldshut-Tiengen (DE)

(73) Assignee: ALSTOM Technology Ltd., Baden (CH)

( * ) Notice: Subject to any disclaimer, the term of this patent is extended or adjusted under 35 U.S.C. 154(b) by 472 days.

(21) Appl. No.: 10/625,467

(22) Filed: Jul. 23, 2003

(65) Prior Publication Data

US 2004/0154308 A1 Aug. 12, 2004

(30) Foreign Application Priority Data

Jul. 25, 2002 (DE) ..... 102 33 805

(51) Int. Cl.
*F23R 3/50* (2006.01)

(52) U.S. Cl. ..... 60/798; 60/752; 60/756; 60/760

(58) Field of Classification Search ..... 60/752, 60/758, 760, 266, 798
See application file for complete search history.

(56) References Cited

U.S. PATENT DOCUMENTS

| | | | | |
|---|---|---|---|---|
| 4,446,693 | A | 5/1984 | Pidcock et al. | |
| 5,363,643 | A | 11/1994 | Halila | 60/39.31 |
| 5,435,127 | A * | 7/1995 | Luffy et al. | 60/266 |
| 6,047,552 | A * | 4/2000 | Gross et al. | 60/760 |
| 6,301,877 | B1 * | 10/2001 | Liang et al. | 60/266 |
| 2002/0116929 | A1 * | 8/2002 | Snyder | 60/752 |

FOREIGN PATENT DOCUMENTS

| | | |
|---|---|---|
| CH | 257279 | 9/1967 |
| DE | 34 35 611 A1 | 4/1985 |
| DE | 35 31 227 A1 | 3/1987 |
| DE | 197 27 407 A1 | 1/1999 |
| EP | 1 235 032 A2 | 8/2002 |
| EP | 1363075 | 11/2003 |

OTHER PUBLICATIONS

Search Report from German Application No. 102 33 805.1 (Jul. 9, 2003).
Mukherjee, Dilip K., "State-of-the-art gas turbines—a brief update", ABB Review, vol. 2, pp. 4-14 (ABB, Baden, Switzerland, 1997).
Search Report for European Patent App. No. 03405504.6 (Mar. 6, 2007).

* cited by examiner

*Primary Examiner*—Ted Kim
(74) *Attorney, Agent, or Firm*—Cermak Kenealy & Vaidya LLP; Adam J. Cermak

(57) ABSTRACT

The invention relates to an annular combustor (13) for a gas turbine (10), into which combustor (13) burners (14, 15) open on an inlet side, and which combustor (13) extends in the axial direction from the inlet side to an outlet side (33) and is lined on the insides with cooled liner segments (16, 17) for protection from the hot gases.

In such a combustor, increased mechanical stability and flexibility in design and also simplification in manufacture and fitting are achieved by the liner segments (16, 17) being subdivided in the axial direction into a plurality of parts (16, 17) arranged one behind the other.

10 Claims, 3 Drawing Sheets

ANNULAR COMBUSTOR FOR A GAS TURBINE

FIELD OF THE INVENTION

The present invention relates to the technical field of gas turbines, to an annular combustor for a gas turbine.

Such a combustor, as reproduced, for example, in FIG. 3, has been in use in gas turbines for a long time.

DISCUSSION OF BACKGROUND

A sectional representation of an annular combustor, an "EV combustor" (EV=environmental), according to the prior art is reproduced in FIG. 3. The combustor 26, which is part of a gas turbine (not shown) and of which only the section lying above the turbine axis is reproduced, extends in the longitudinal direction along the turbine axis in the direction of flow (from right to left in FIG. 3). On the inlet side (right-hand side in FIG. 3), a number of burners 27 are distributed on a circular ring concentric to the turbine axis and in the present case are designed as "double-cone burners" according to EP 0321809. However, this is not absolutely necessary, and it goes without saying that the combustors discussed here may also be operated with other burner variants. The swirled fuel/air mixture discharging from the burners 27 burns, while forming a flame, in the primary zone 30 following the burners 27, and the hot gases produced discharge from the combustor 26 at a combustor outlet 31 and enter the downstream turbine part, where they expand while performing work. In order to protect the combustor walls 29 from the hot gases, special liner segments 28 are arranged and fastened on the inside of the combustor walls 29. The liner segments 28 are designed to be continuous in the axial direction and are therefore as long as the interior space of the combustor 26. This has the advantage that the number of parts and the length of the leaky gaps is minimal.

A disadvantage with the known configuration of the liner elements, however, is that the segments are comparatively long. This creates problems with regard to ease of manufacture and the mechanical integrity. These problems become even greater and possibly cannot be solved if correspondingly large combustors having very long liner segments are required for very large gas turbines.

SUMMARY OF THE INVENTION

Accordingly, one object of the invention is to provide a novel combustor which avoids the above-described disadvantages of known combustors and is characterized by simplification of manufacture and fitting and by improved mechanical stability and improved mechanical and thermal loading capacity.

An aspect of the present invention includes the fact that, in a combustor of the type mentioned at the beginning, the liner segments are subdivided in the axial direction into a plurality of parts arranged one behind the other. The individual elements become smaller due to the division, as a result of which their manufacture is simplified and the mechanical stability is increased. At the same time, the fitting of the segments is simplified.

In this case, it has proved to be especially favorable if the liner segments, according to a preferred configuration of the invention, are subdivided into two parts, if the liner segments are subdivided where the flow velocity of the hot gases is low, or if the liner segments are subdivided in such a way that the lengths of the individual segment parts in the axial direction are approximately the same.

The fitting can be further simplified if, according to another configuration of the invention, the liner segments are fastened to segment carriers, and the segment carriers are likewise subdivided in the axial direction into a plurality of parts.

The liner segments are preferably convection-cooled.

In this case, the subdivided liner segments can be convection-cooled separately, the cooling medium flowing through those parts of the liner segments which are situated downstream being released into the hot-gas flow of the combustor.

However, it is also conceivable for transition channels to be provided between the subdivided liner segments, through which transition channels the convectively cooling cooling medium can flow from, one part of the liner segments into the other part of the liner segments.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

WAYS OF IMPLEMENTING THE INVENTION

Figure 1:
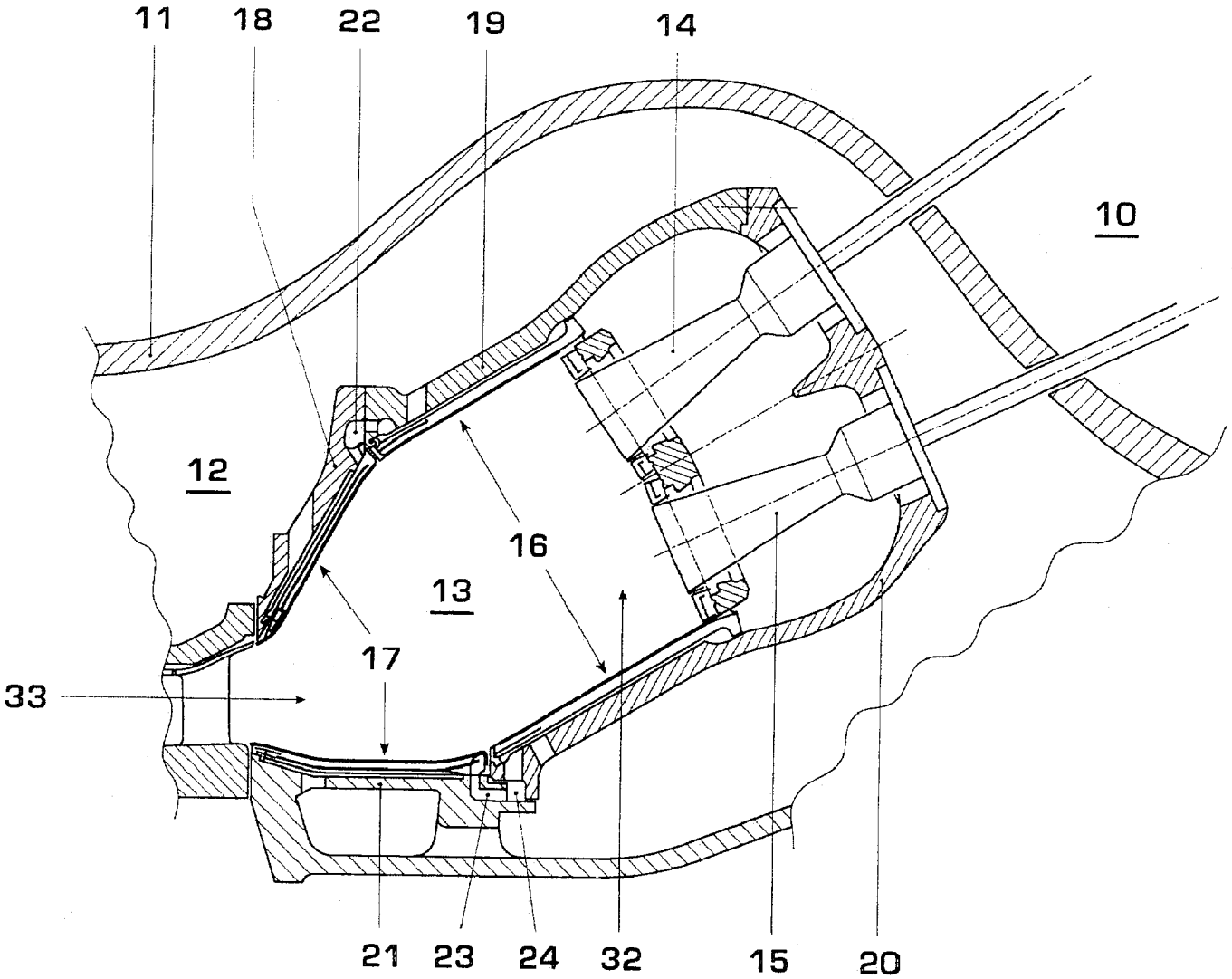
FIG. 1 shows a section through a combustor, arranged in a gas turbine and having liner segments subdivided in the axial direction, according to a preferred exemplary embodiment of the invention.

Referring now to the drawings, wherein like reference numerals designate identical or corresponding parts throughout the several views, in FIG. 1, a section through a combustor, arranged in a gas turbine and having liner segments subdivided in the axial direction, according to a preferred exemplary embodiment of the invention is reproduced. The gas turbine 10, of which only a part lying above the turbine axis is shown, has an outer turbine casing 11 which surrounds a plenum chamber 12 which is filled with compressed air and in which the actual annular combustor 13 is arranged. The flow occurs from right to left in FIG. 1. By the burners 14, 15, which are arranged in a head space of the combustor 13 and lie one above the other in two rows, the fuel/air mixture is injected into the primary zone 32 of the combustor 13 and burns there while forming flames. The hot gases produced discharge from the combustor 13 through the combustor outlet 33 and enter the downstream turbine. The combustor 13 is separated from the surrounding plenum chamber 12 by a plurality of segment carriers 18, . . . , 21. First and second liner segments 16 and 17 are fastened one behind the other in the axial direction to the inner walls of the segment carriers 18, . . . , 21, inner liner segments (at the bottom in FIG. 1) and outer liner segments (at the top in FIG. 1) being provided in each case. The divided liner segments 16, 17 have approximately the same (axial) length and are divided where the associated segment carriers 19, 20 and 18, 21 meet. The location at which the divided liner segments 16, 17 meet (space 24 in FIG. 2) lies where the flow velocity of the hot gases is low. The divided liner segments 16, 17 are convectively cooled in the same way as is already the case with the undivided liner segments.

The division of the segment carriers 18, . . . , 21 means that the assembly is simplified. This applies in particular to the inner (bottom) liner. If the inner liner is composed of two parts, the separating gap can be screwed over the entire length. In this case, the separating line of the segment carriers 18, 21 for the second liner segments 17 is accessible for screw bolts, so that a wedge is no longer required.

The division according to the invention of the liner segments enables larger combustors to be realized without correspondingly large segments having to be constructed. In this way, recourse may be had to already proven segment sizes. The invention also enables the same burners 14, 15 and first liner segments 16 to be used in different gas turbines. Only the combustor outlet 33 having the second liner segments 17 and their segment carriers 18, 21 is then adapted to the different turbine inlet geometries.

Figure 2:
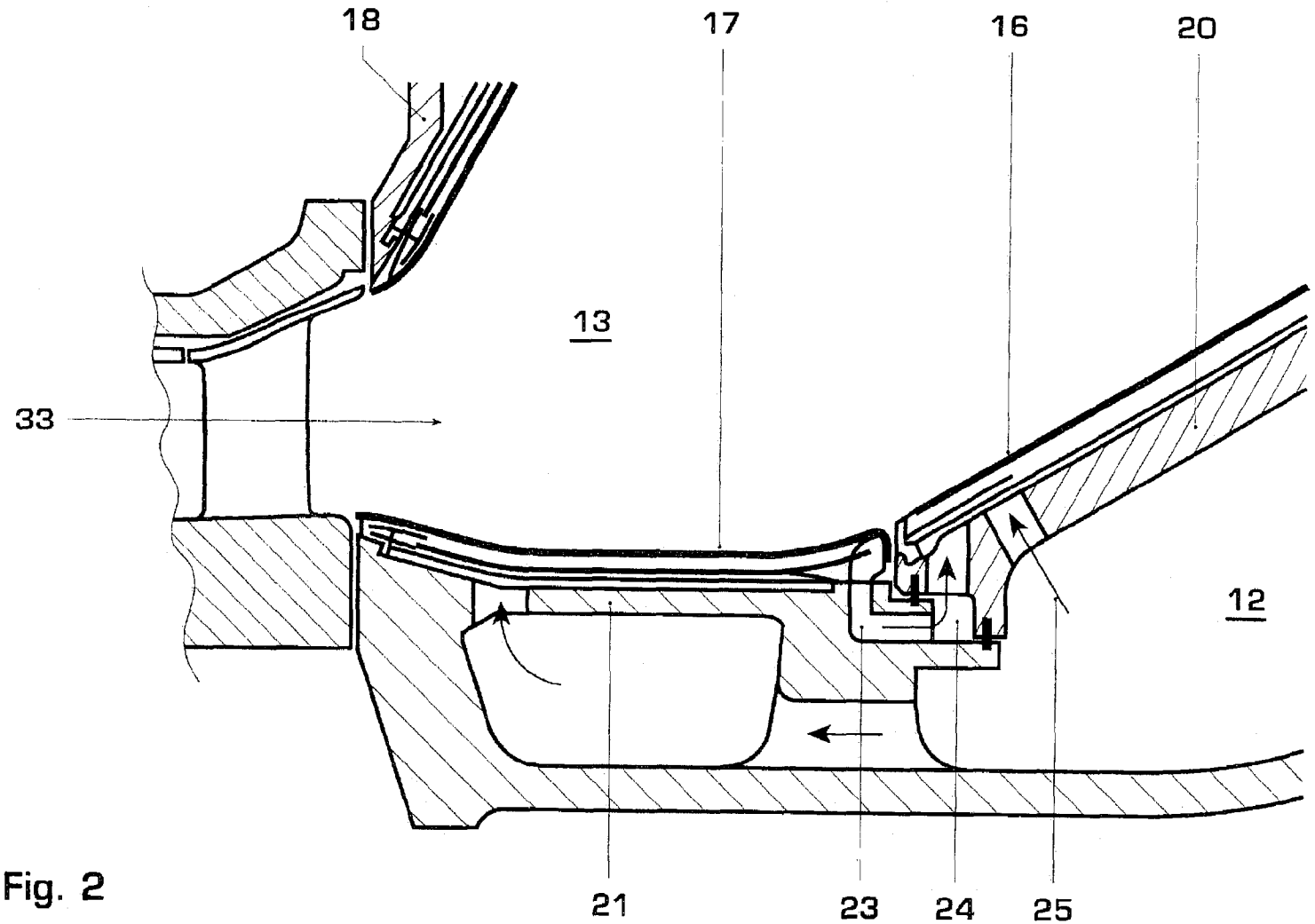
FIG. 2 shows an enlarged detail from the representation of FIG. 1.
Figure 3:
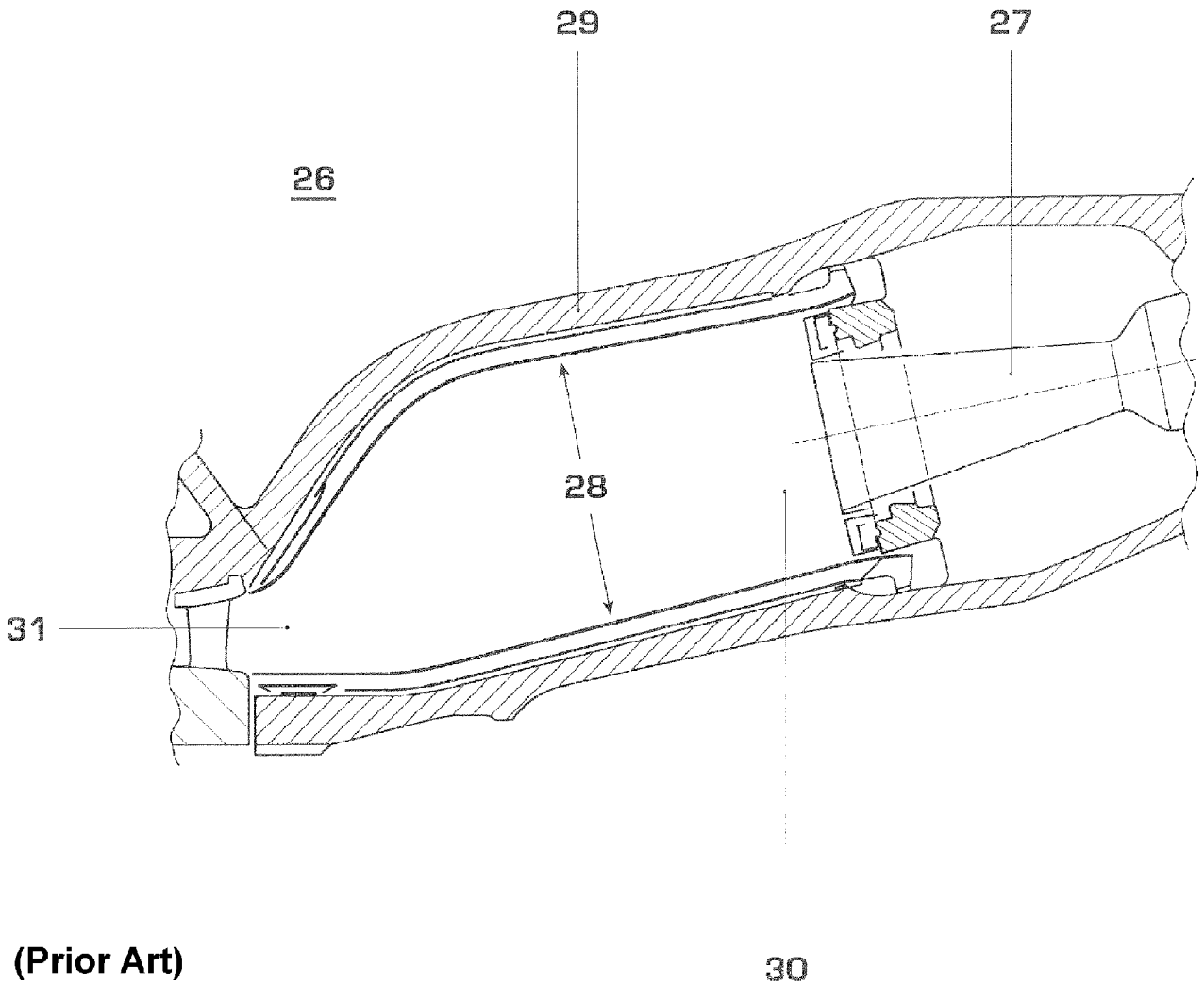
Fig. 3 (Prior Art)
FIG. 3 shows a section through an annular combustor according to the prior art.

The liner segments 16, 17 are thus configured as in the GT24B and GT26B type EV and SEV combustors of the known gas turbines of the applicant (in this respect see the article by D. K. Mukherjee "State-of-the-art gas turbines—a brief update", ABB review February, 1997, pages 4-14 (1997)). A special feature is the provision of transition channels 22, 23 (FIGS. 1 and 2) between the second liner segments 17 and the first liner segments 16. The cooling air used for the convective cooling of the liner segments 16, 17 can flow through these transition channels 22, 23 from the second liner segments 17 into the first liner segments 16 and can contribute to the cooling there. The cooling system of the second liner segments 17 is operated with only part of the entire mass cooling flow in order to keep the flow velocities low for avoiding pressure drops in the transition channels 22, 23. An additional partial flow 25 is required for cooling the first liner segments 16 (FIG. 2). The transition region between the inner second and first liner segments 17 and 16 is shown enlarged in FIG. 2.

However, it is also conceivable to dispense with the transition channels 22, 23 and to design the cooling systems of the first and second liner segments 16, 17 separately. The cooling air from the second liner segments 17 is then, released into the, hot-gas flow. In this case, the second liner segments 17 are markedly shorter and are optimized for a minimum consumption of cooling air. The advantage of the separate cooling lies in the fact that the transition channels 22, 23, which are complicated from the production point of view, can be dispensed with and that air is available for influencing the hot-gas temperature distribution and for cooling the gap between burner chamber and turbine. This advantage is offset by a reduced mass air flow in the burner and a small height of the cooling channels in the second liner segments 17.

Obviously, numerous modifications and variations of the present invention are possible in light of the above teachings. It is therefore to be understood that within the scope of the appended claims, the invention may be practised otherwise than as specifically described herein.

LIST OF DESIGNATIONS

10 Gas turbine
11 Outer turbine casing
12 Plenum chamber
13, 26 Combustor (annular)
14, 15, 27 Burner
16, 17 Liner segment
18, . . . , 21 Segment carrier
22, 23 Transition channels
24 Space
25 Partial flow
28 Liner segment
29 Combustor wall
30, 32 Primary zone
31, 33 Combustor outlet

What is claimed is:

1. An annular combustor for a gas turbine, comprising: a wall, an inlet side, and an outlet side, the inlet side configured and arranged to accept burners opening on the inlet side, the combustor extending in an axial direction from the inlet side to the outlet side, cooled liner segments lining insides of the wall for protection from hot gases;

wherein the liner segments are subdivided in the axial direction into a plurality of non-overlapping and angled parts arranged one behind the other; and a plurality of segment carriers, the liner segments being fastened to the segment carriers, the segment carriers being subdivided in the axial direction into a plurality of separate, detachably connected parts, each having substantially the same length as its corresponding linger segment, at least one junction of adjacent segment carriers forming together a wedge shape.

2. The combustor as claimed in claim 1, wherein the liner segments are subdivided into two parts.

3. The combustor as claimed in claim 2, wherein the liner segments are subdivided where the flow velocity of the hot gases is low.

4. The combustor as claimed in claim 3, wherein the liner segments are subdivided in such a way that the lengths of individual segment parts in the axial direction are approximately the same.

5. The combustor as claimed in claim 1, wherein the liner segments are convection-cooled.

6. The combustor as claimed in claim 5, wherein the subdivided liner segments are separately convection-cooled.

7. The combustor as claimed in claim 6, further comprising:

cooling medium flowing though those parts of the liner segments which are situated downstream, the cooling medium being released into a hot-gas flow of the combustor.

8. The combustor as claimed in claim 5, further comprising:

transition channels provided between the subdivided liner segments, though which transition channels the convectively cooling cooling medium can flow from one part of the liner segments into the other part of the liner segments.

9. The combustor as claimed in claim 5, wherein parts of the liner segments which are located downstream are cooled only by part of the mass flow provided overall for the cooling of the liner segments.

10. The combustor as claimed in claim 1, further comprising:

at least one burner positioned at the inlet side.

* * * * *